US012570376B2

(12) United States Patent
Chebat

(10) Patent No.: US 12,570,376 B2
(45) Date of Patent: Mar. 10, 2026

(54) PERSONAL WATERCRAFT DOCKING APPARATUS

(71) Applicant: Jason George Chebat, Buffalo, NY (US)

(72) Inventor: Jason George Chebat, Buffalo, NY (US)

( * ) Notice: Subject to any disclaimer, the term of this patent is extended or adjusted under 35 U.S.C. 154(b) by 486 days.

(21) Appl. No.: 18/183,131

(22) Filed: Mar. 13, 2023

(65) Prior Publication Data

US 2023/0278674 A1 Sep. 7, 2023

Related U.S. Application Data

(63) Continuation-in-part of application No. 17/100,676, filed on Nov. 20, 2020, now Pat. No. 11,603,169.

(51) Int. Cl.
*B63B 21/00* (2006.01)

(52) U.S. Cl.
CPC ..... *B63B 21/00* (2013.01); *B63B 2021/001* (2013.01)

(58) Field of Classification Search
None
See application file for complete search history.

(56) References Cited

U.S. PATENT DOCUMENTS 7,827,924 B1 * 11/2010 Perez ..... B63B 21/00 114/230.15
8,360,813 B1 * 1/2013 Alvarez ..... B63B 21/54 114/221 R
2015/0183115 A1 * 7/2015 Pe ..... B25J 1/04 294/106

* cited by examiner

*Primary Examiner* — Juan G Flores
(74) *Attorney, Agent, or Firm* — Parsons & Goltry; Robert A. Parsons; Michael W. Goltry

(57) ABSTRACT

Watercraft docking apparatus including a flexible clamp attachable to a watercraft to be docked, an elongated pole attached at one end to the flexible clamp, and structure attaching mechanism attached to an opposite end of the elongated pole. The flexible clamp and the structure attaching mechanism are both designed to prevent lateral horizontal movement of the elongated pole.

18 Claims, 8 Drawing Sheets

PERSONAL WATERCRAFT DOCKING APPARATUS

CROSS-REFERENCE TO RELATED APPLICATION

This application is a Continuation-In-Part of currently pending U.S. patent application Ser. No. 17/100,676, filed on Nov. 20, 2020.

FILED OF THE INVENTION

This invention relates to apparatus for docking or attaching personal watercraft to a dock or other structure.

BACKGROUND OF THE INVENTION

In many instances it may be desirable to attach personal watercraft, such as jetskis and the like, to a dock temporarily or even for extended periods of time (e.g. days). Generally personal watercraft are relatively light and will be susceptible to movement in response to waves, wind, and the like striking them. Tying a personal watercraft to a dock or other structure generally requires some padding or the like between the personal watercraft and the dock or other structure since the simple tying allows movement and this movement can cause the personal watercraft to strike the dock, or other structure to which it is attached, causing damage to the personal watercraft. Even padding sufficient to absorb bumps can cause damage, scratches, dents, weakening of the watercraft hull etc.

Also, in most prior art attaching devices, a person must first get into the watercraft and attach one end of the rope, etc. making-up the attaching device. The person must then get out of the watercraft and attach the other end of the rope, etc. to the dock. This entire process, including the maneuvering of the watercraft during the process, can be extremely time consuming and burdensome.

It would be highly advantageous, therefore, to remedy this and other deficiencies inherent in the prior art.

Accordingly, it is an object of the present invention to provide new and improved personal watercraft docking apparatus.

It is another object of the present invention to provide new and improved personal watercraft docking apparatus that prevents all contact of the watercraft with the dock or other structure to which it is attached.

It is another object of the present invention to provide new and improved personal watercraft docking apparatus that is easy and convenient to use.

SUMMARY OF THE INVENTION

Briefly to achieve the desired objects and advantages of the present invention watercraft docking apparatus is disclosed. The apparatus includes a flexible clamp, an elongated pole attached at one end to the flexible clamp, and structure attaching mechanism attached to an opposite end of the elongated pole, the flexible clamp and the structure attaching mechanism are both designed to prevent lateral horizontal movement of the elongated pole. The flexible clamp includes a base element having an upper end and a lower end, an upper clamp element coupled to the upper end of the base element, and a lower clamp element coupled to the lower end of the base element. The upper clamp element and the lower clamp element oppose one another and at least the upper clamp element is movable inwardly toward the lower clamp element to an engaged position and movable outwardly away from the lower clamp element to a disengaged position. In a specific aspect, the flexible clamp is moved to the engaged position by a cable and to the disengaged position by an elastomeric band.

The desired objects and advantages of the instant invention are further achieved in a preferred example of watercraft docking apparatus including a flexible clamp, an elongated pole attached at one end to the flexible clamp, and structure attaching mechanism attached to an opposite end of the elongated pole, the flexible clamp and the structure attaching mechanism are both designed to prevent lateral horizontal movement of the elongated pole. The flexible clamp including a base element having an upper end and a lower end, an upper clamp element having a proximal segment and a distal segment pivotally coupled in series to the upper end of the base element, and a lower clamp element coupled to the lower end of the base element. The upper clamp element and the lower clamp element oppose one another and the upper clamp member is movable inwardly toward the lower clamp member to an engaged position and movable outwardly away from the lower clamp member to a disengaged position.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION

Figure 1:
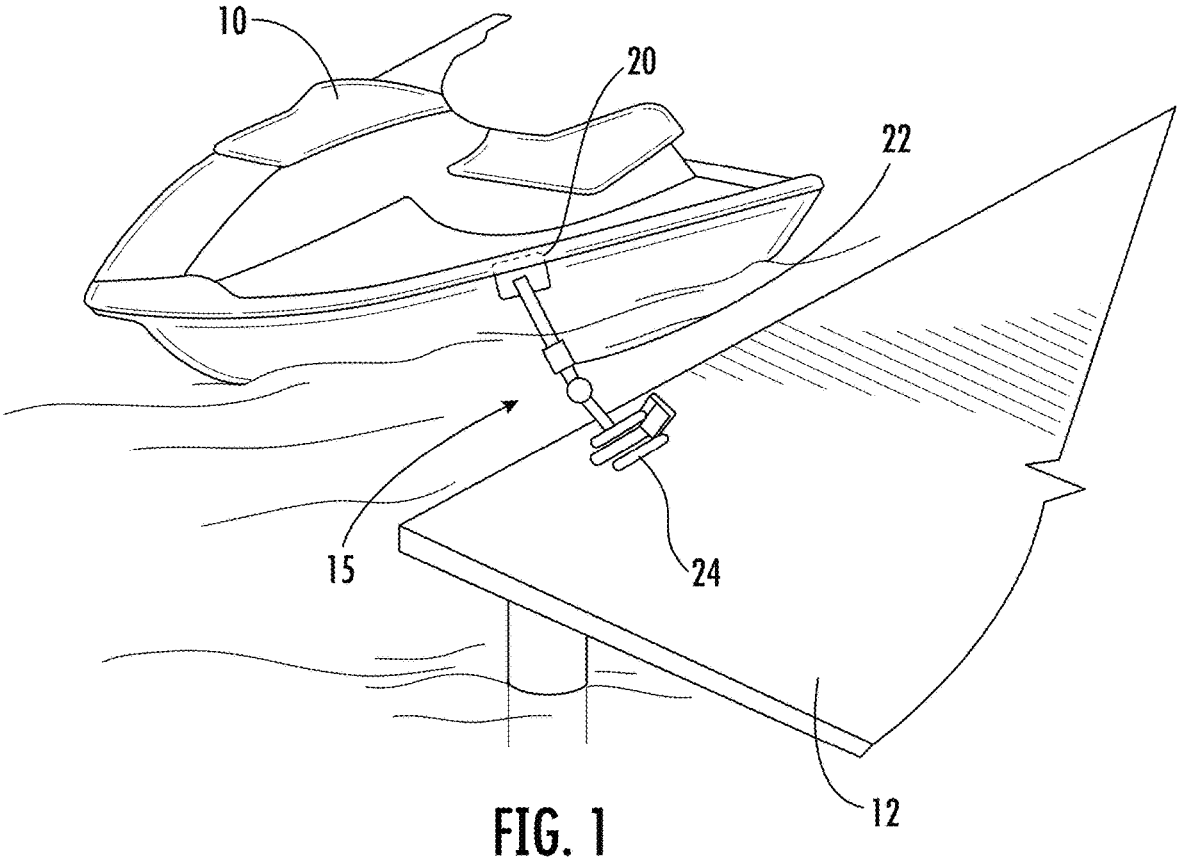
FIG. 1 illustrates a personal watercraft attached to a dock by apparatus according to the present invention.

Turning to FIG. 1, a personal watercraft 10, which in this example is a jetski, is illustrated attached to a dock 12 by watercraft docking apparatus 15, in accordance with the present invention. In this specific embodiment, apparatus 15 includes a spreadable clamp 20 attached to one end of an elongated pole 22 with a dock tying mechanism 24 attached to the opposite end.

Figure 2:
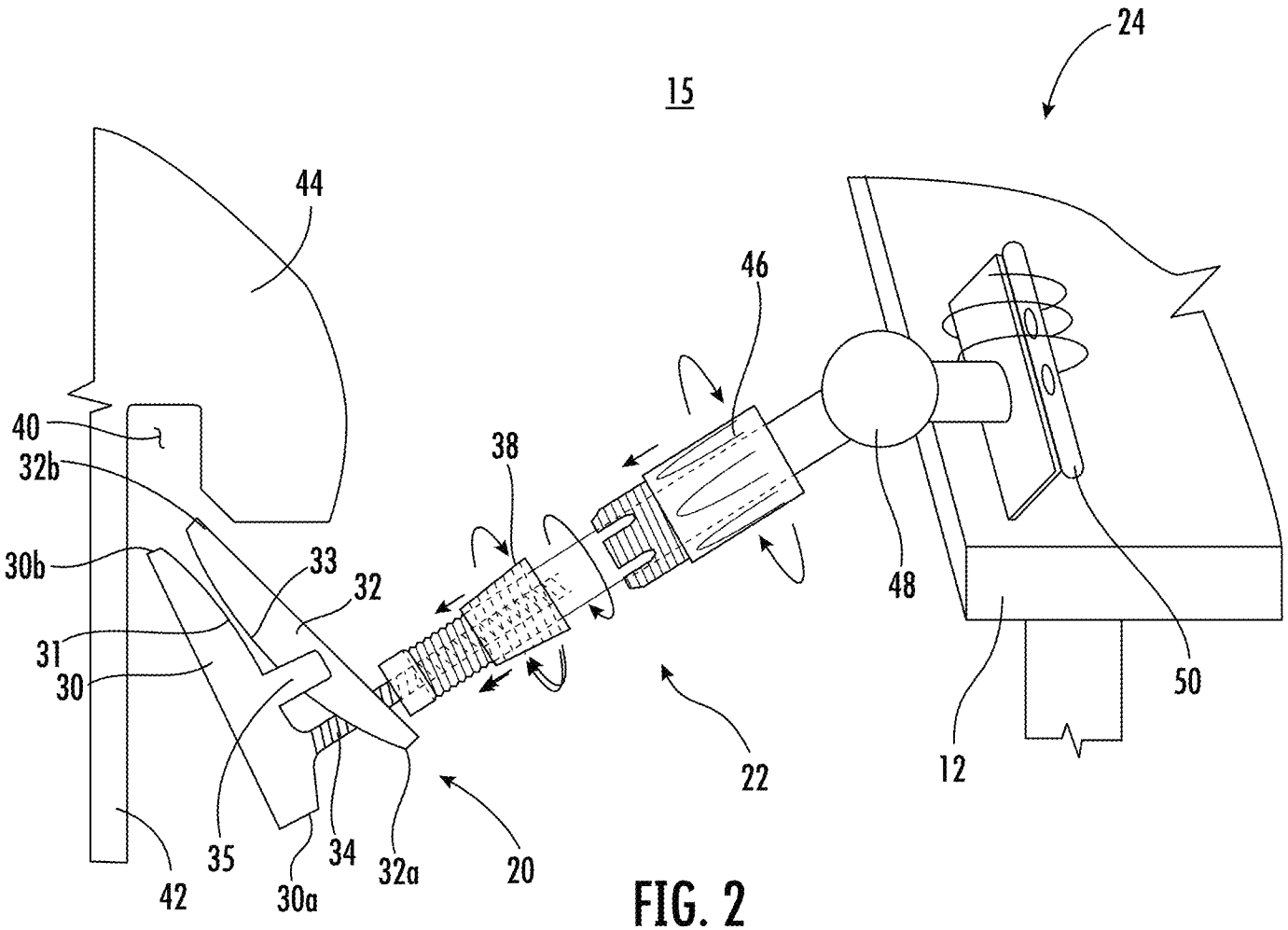
FIG. 2 is an enlarged perspective view of the watercraft docking apparatus illustrated in FIG. 1.

Turning now to FIG. 2, an enlarged view of watercraft docking apparatus 15 is illustrated. In this embodiment, spreadable clamp 20 includes an outer or distal clamp element 30 and an inner clamp element 32. In this description the term "outer" is defined as facing away or farther away from the dock and the term "inner" is defined as facing toward or nearer to the dock. Both element 30 and element 32 are formed from rectangular pieces of stiff material, such as metal, plastic, wood, rubber, fiber glass, carbon fiber, or the like and when in the attached mode extend parallel to the hull of personal watercraft 10 at least a few inches (see FIG. 1). Outer clamp element 30 includes a threaded portion or rod-like element 34 that extends approximately perpendicularly away from the rear side and threads into female threads formed in an opening in the end of pole 22. Threaded rod-like portion 34 and the internally threaded opening in the one end of elongated pole 22 are each axially elongated sufficiently to allow a threading rotation to move outer clamp element 30 toward and away from the one end of elongated pole 22. Inner clamp element 32 has an opening therethrough to allow rod-like element 34 to threadedly engage the end of elongated pole 22. A clamp positioning stabilizer 35 is formed as a part of (e.g. a flange) or attached to the inner surface of outer clamp element 30 and serves to hold inner clamp element 32 parallel with outer clamp element 30 and to prevent relative rotation between outer clamp element 30 and inner clamp element 32. It will be understood that stabilizer 35 can also include a second flange extending from the outer surface of outer clamp element 30. An outer surface of pole 22 is threaded and a movable nut or clamp securing nut 38 is threadedly engaged with pole 22 to provide a surface for inner clamp element 32 to but against.

Outer clamp element 30 has an arcuate inner surface (vertical cross-section) 31 that arcs generally from the lower edge of element 30, designated 30*a*, to the upper edge of element 30, designated 30*b*. Inner clamp element 32 has an arcuate outer or distal surface (vertical cross-section) 33 that arcs generally from the lower edge of element 32, designated 32*a*, to the upper edge of element 32, designated 32*b*. Further, surface 31 and surface 33 arc away from each other and inner clamp element 32 is angularly disposed so that any movement of element 30 and/or element 32 toward each other will cause a relative rolling or spreading motion of upper edges 30*b* and 32*b*.

In the operation of spreadable clamp 20 it must first be noted that watercraft 10 is constructed to form a downwardly opening recess 40 between hull 42 and an overhanging lip 44. To attach spreadable clamp 20 to watercraft 10, upper edge 30*b* of outer clamp element 30 and upper edge 32*b* of inner clamp element 32 are inserted into recess 40. Pole 22 is then rotated (clockwise in FIG. 2) about its longitudinal axis so that rod-like element 34 threads further into the female threads formed in the end of pole 22. The longitudinal movement of outer clamp element 30 towards inner clamp element 32 causes the arcuate surfaces 31 and 33 to provide a relative rolling action, causing upper edges 30*b* and 32*b* to spread slightly, thereby holding them tightly in recess 40. Optionally, at least the outer surface of outer clamp element 30 and the inner surface of inner clamp element 32 can be covered with a softer, rougher and/or resilient material (e.g. rubber, softer plastic, etc.) to reduce slippage and ensure a secure hold of clamp 20 in recess 40 and to minimize any scratching, etc. of the surfaces of personal watercraft 10. It should be noted that the amount of longitudinal movement of outer clamp element 30 will be very small and looseness of the fitting between inner clamp element 32 and the end of pole 22 (and/or clamp securing nut 38) will be sufficient to allow the rolling or spreading motion of upper edges 30*b* and 32*b*. One advantage provided by spreadable clamp 20 and watercraft docking apparatus 15 is that watercraft docking apparatus 15 can be securely attached to a personal watercraft from the dock.

A pole extending nut 46 is rotatably mounted in a mid-section of pole 22 and provides for optional longitudinal extension or retraction of pole 22. As is well-known in the art, there are a variety of ways that changing the length of pole 22 may be achieved. For example, pole 22 may include two (or more) lengths nested coaxially together or a simple telescoping arrangement. In any case pole 22 is extendable by rotating/loosening movable nut 46 relative to pole 22, changing the length of pole 22, and simply tightening nut 46 onto coaxially extended pole 22. Thus, the length of pole 22 is adjustable to position watercraft 10 a desired distance from dock 12 or other structure.

Figure 3:
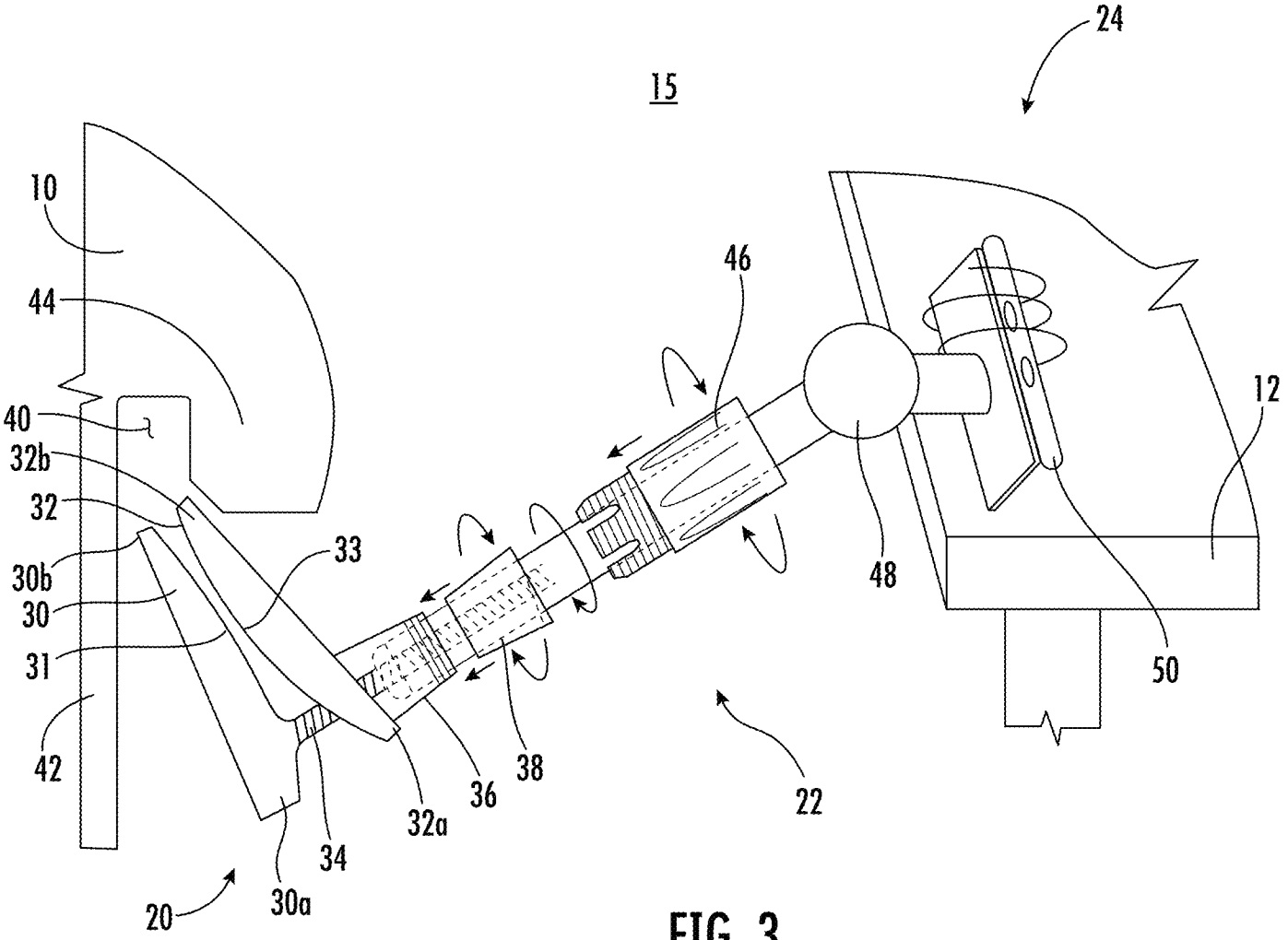
FIG. 3 is an enlarged perspective view of a modification of the watercraft docking apparatus illustrated in FIG. 2.

Referring additionally to FIG. 3, a modification is illustrated of the embodiment of spreadable clamp 20 described above. In this modification inner clamp element 32 has a cylindrical body portion 36 forming a portion of the inner surface with the end of pole 22 extending coaxially into a central opening in cylindrical body portion 36 so that inner clamp element 32 is rotatably butted against the outer or distal end of elongated pole 22. In this embodiment an outer surface of cylindrical body portion 36 is threaded and movable nut or clamp securing nut 38 is threadedly engaged with cylindrical body portion 36 to hold inner clamp element 32 fixed with relation to outer clamp element 30. Thus, clamp positioning stabilizer 35 is not required in this modification.

In the preferred embodiment illustrated in FIG. 2 and the modification illustrated in FIG. 3, the end of pole 22 opposite spreadable clamp 20 is attached to dock tying mechanism 24 by a rotatable joint 48. Joint 48 allows rotational movement of pole 22 in a vertical direction but prevents movement in a horizontal direction. Vertical movement of pole 22 is desirable in many instances because the height of dock 12 or any other structure to which watercraft 10 is connected, may vary radically relative to the height of watercraft 10. However, in many instances watercraft 10 may be attached to only one or two different docks/structures and rotatable joint 48 is simply an optional addition.

Figures 4A, 4B:
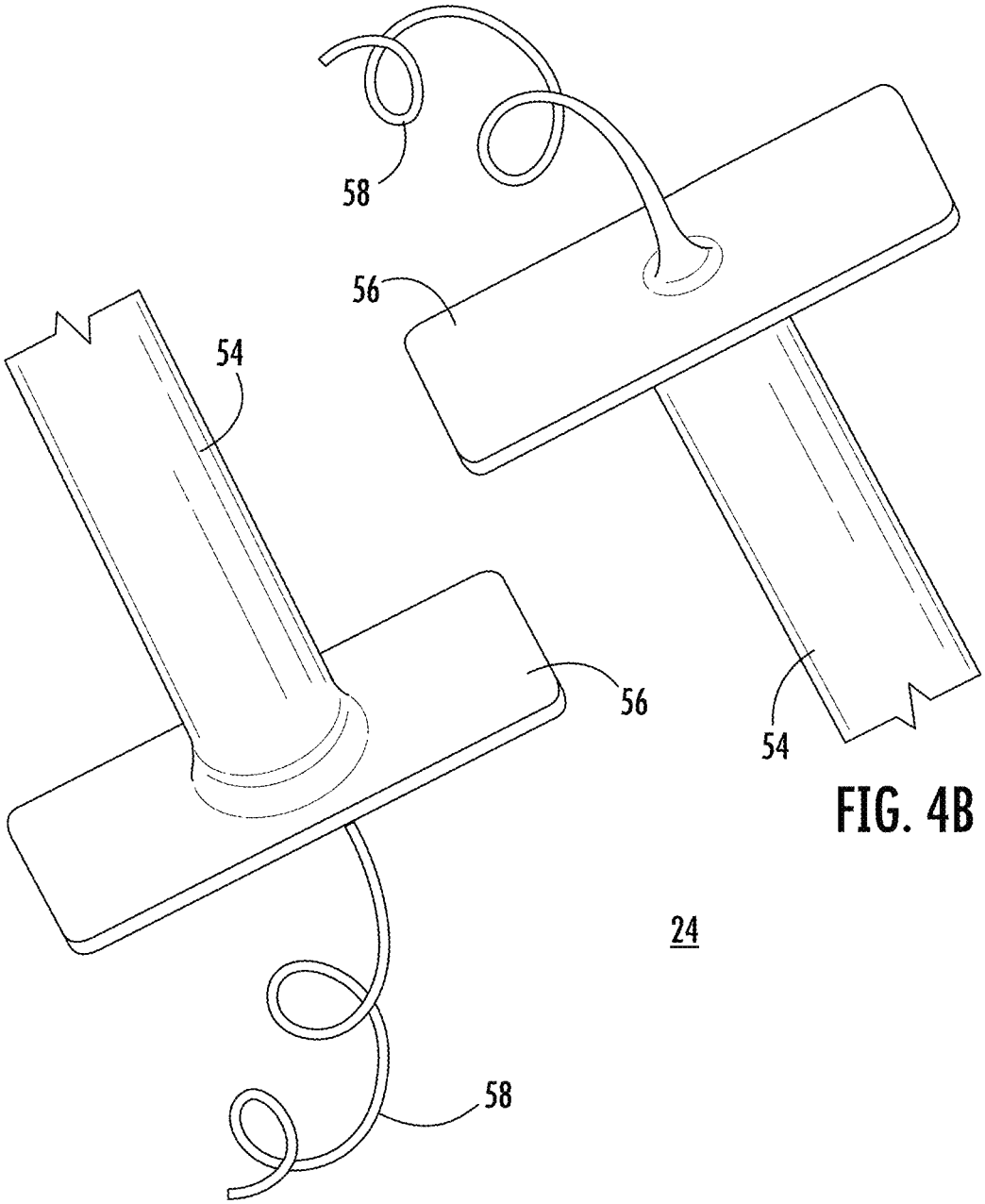
FIGS. 4A and 4B are enlarged perspective top and bottom views, respectively, of a portion of the watercraft docking apparatus illustrated in FIG. 1.

Turning to FIGS. 4A and 4B, an example of dock tying mechanism 24 is illustrated. This specific example of mechanism 24 is designed to attach to a cleat 50 (see FIGS. 2 and 3) many of which are available on docks and the like. In this specific example, mechanism 24 includes a pole element 54, one end of which attaches to rotatable joint 48 and the other end of which has a rectangular, laterally extending foot 56 fixedly attached thereto. Foot 56 may be formed as an integral part of pole 54 or may be otherwise fixedly attached thereto. A flexible, formable securing wrap 58 (e.g. rubber coated cable, etc.) has one end attached to the surface of foot 56 by any convenient means, such as spot welding, etc. In operation, foot 56, which in this example is approximately the same length as cleat 50, is butted tightly against cleat 50 and the free end of securing wrap 58 is wrapped around foot 56 and cleat 50 to hold foot 56 tightly in place. Because foot 56 has a horizontal or lateral length, horizontal rotational movement of pole element 54 is prevented.

Figure 5:
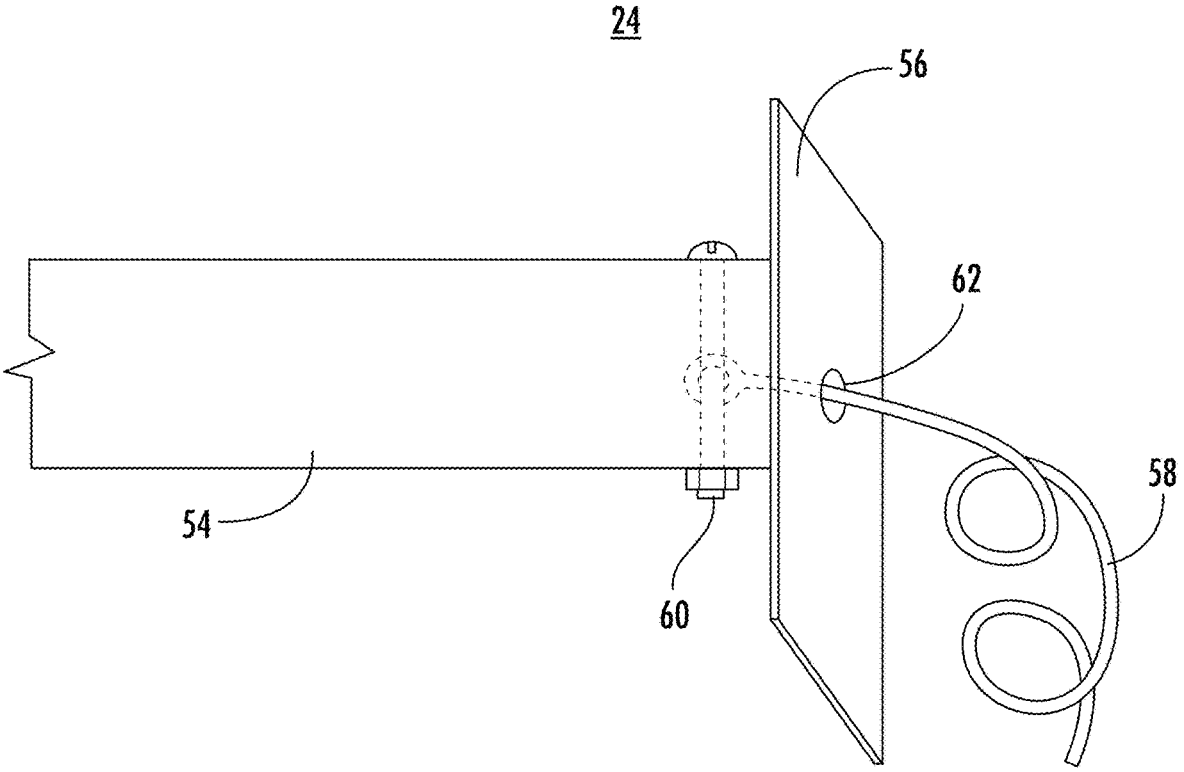
FIG. 5 is an enlarged perspective view of a modification of the portion of the watercraft docking apparatus illustrated in FIG. 4.

Turning to FIG. 5, a modification of the dock tying mechanism 24 in FIGS. 4A and 4B is illustrated. In this specific example, mechanism 24 includes a pole element 54, one end of which attaches to rotatable joint 48 and the other end of which has a rectangular, laterally extending foot 56 fixedly attached thereto by any convenient means, such as welding or the like. A flexible, formable securing wrap 58 (e.g. rubber coated cable, etc.) has one end attached within the end of pole element 54 by a bolt and nut assembly 60 and the other end, which hangs free, extending through a hole 62 in foot 56. While specific examples of dock tying mechanism 24 are illustrated and described, it will be understood that some modifications may be introduced that perform the same functions and any such modifications that come within the scope of the claims are intended to be included herein.

Figure 6:
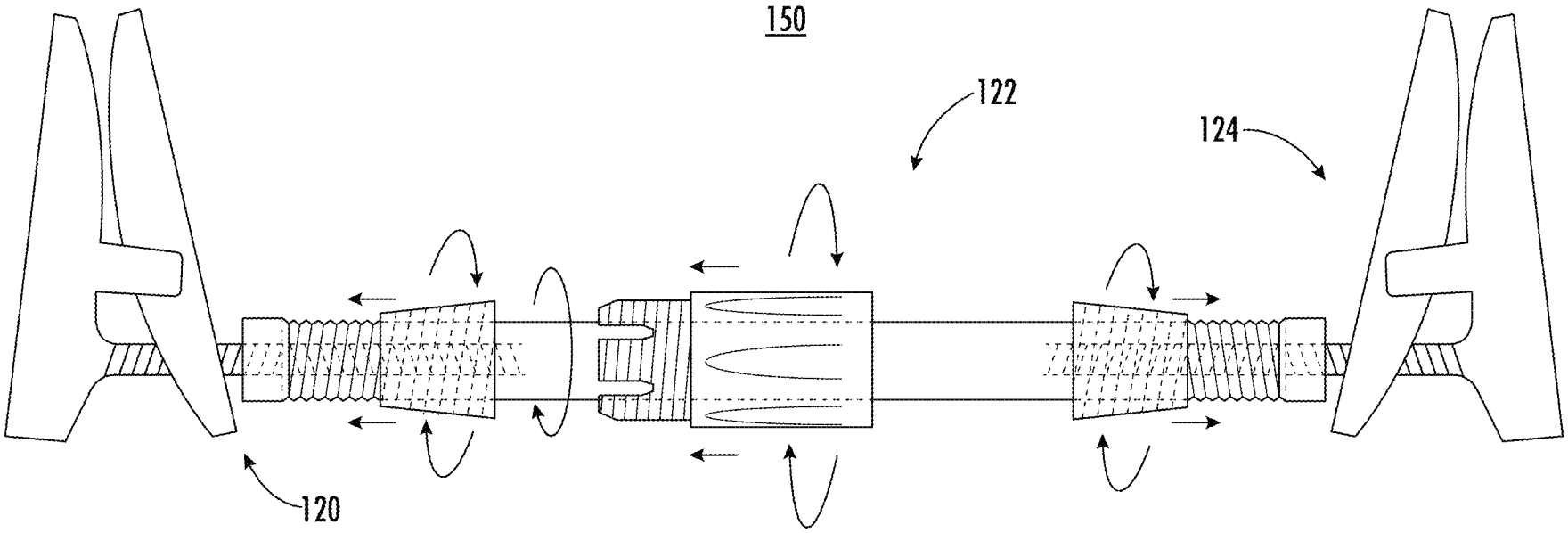
FIG. 6 is another embodiment of the watercraft docking apparatus of FIG. 2 in accordance with the present invention.

Turning to FIG. 6, an alternative embodiment, designated 150, of watercraft docking apparatus 15 is illustrated. Apparatus 150 includes a spreadable clamp 120 attached to one end of an extendable pole 122 with a similar spreadable clamp 124 attached to the opposite end, in place of dock tying mechanism 24. Both spreadable clamps 120 and 124 are similar to spreadable clamp 20 of FIG. 2 and operate as described with relation to FIG. 2. Using this alternative embodiment, personal watercraft (e.g. watercraft 10 above) can be attached to another personal watercraft without the danger of the watercraft bumping together and damaging each other.

Figure 7:
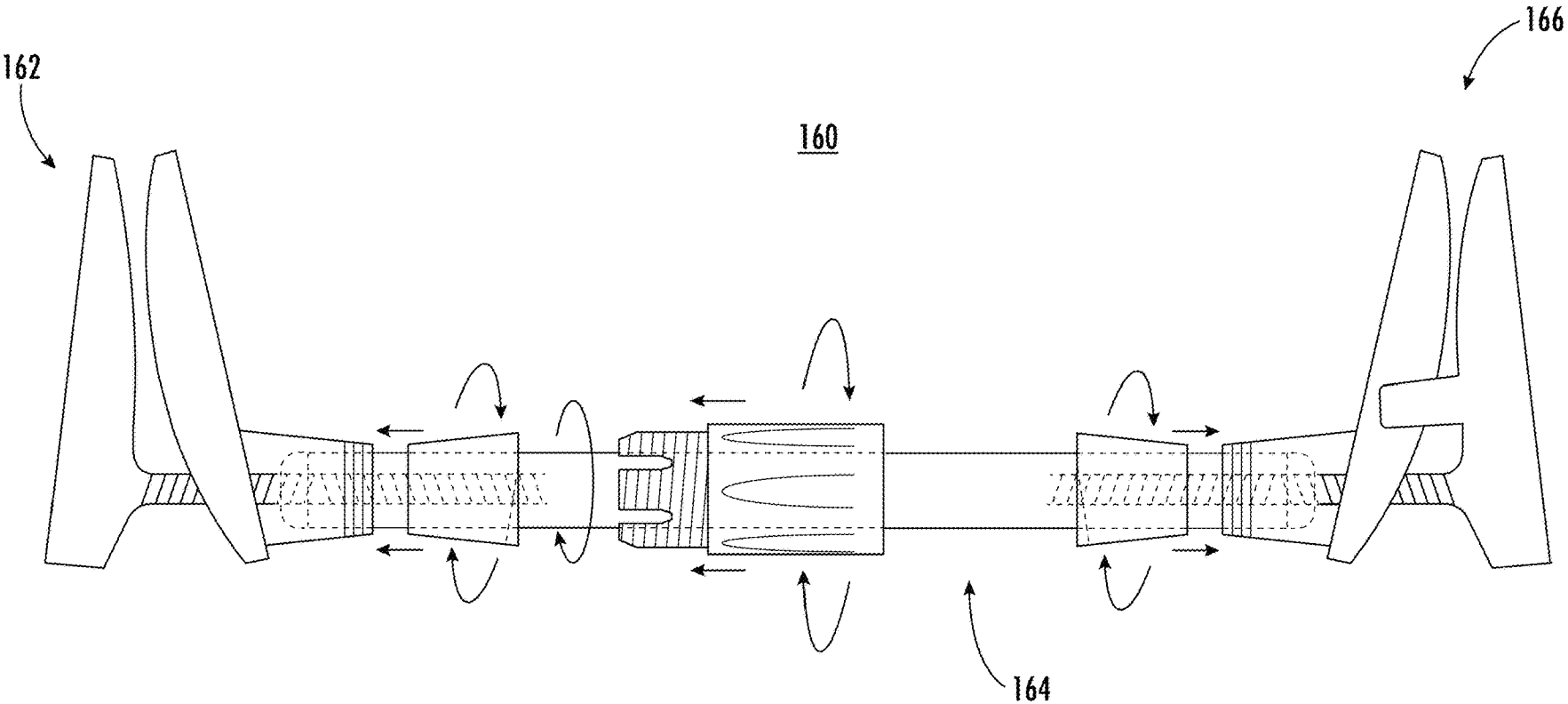
FIG. 7 is a modification of the embodiment of the watercraft docking apparatus of FIG. 6 in accordance with the present invention.

Turning to FIG. 7, a modification, designated 160, of the embodiment designated 150, of watercraft docking apparatus 15 is illustrated. Apparatus 160 includes a spreadable clamp 162 attached to one end of an extendable pole 164 with a similar spreadable clamp 166 attached to the opposite end, in place of dock tying mechanism 24. Both spreadable clamps 162 and 166 are similar to modified spreadable clamp 20 of FIG. 3 and operate as described with relation to FIG. 3. It should be understood that in this disclosure both dock tying mechanism 24 and watercraft docking apparatus 150/160 come within the general definition of the term "structure attaching mechanism".

Figure 8:
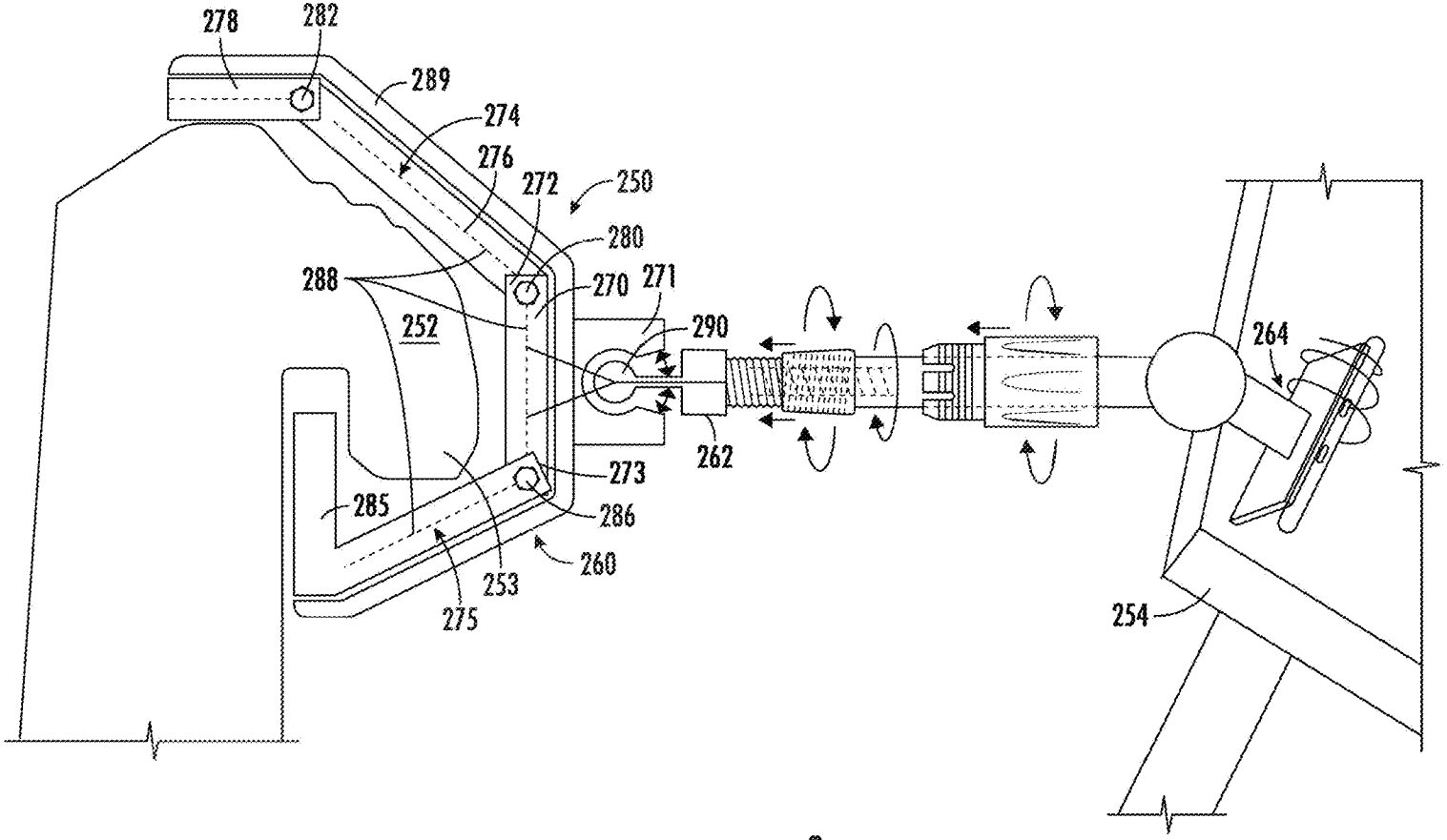
FIG. 8 is an enlarged perspective view of another embodiment of a watercraft docking apparatus using a flexible clamp assembly.

Referring now to FIG. 8, another embodiment of a watercraft docking apparatus, designated 250, is illustrated. A bumper portion 252 with a lip 253 defining a gap of a watercraft such as a jetski is attached to a dock 254 by watercraft docking apparatus 250, in accordance with the present invention. In this specific embodiment, apparatus 250 includes a flexible clamp assembly 260 attached to one end of an elongated pole 262 with a dock tying mechanism 264 attached to the opposite end.

Still referring to FIG. 8, an enlarged view of watercraft docking apparatus 250 is illustrated. In this embodiment, flexible clamp 260 includes a base element 270 having an upper end 272, a lower end 273, and a socket member 271. Flexible clamp 260 further includes an upper clamp element 274 and a lower clamp element 275. In this preferred embodiment, Flexible clamp assembly 260 is articulated, as will be described, but can also be simply flexible as will also be described. In an articulated version upper clamp element 274 is formed with a proximal segment 276 and a distal segment 278. Proximal segment 276 is pivotally coupled to upper end 272 of base element 270 by a pivot element 280, and distal segment 278 is pivotally coupled to proximal segment 276 by a pivot element 282. Lower clamp element 275 includes an angled segment 285 pivotally coupled to lower end 273 of base element 270 by a pivot element 286. Upper clamp element 274 and lower clamp element 275 oppose one another in a very general trough or U-shape and are movable inwardly toward one another to an engaged position and movable outwardly away from one another to a disengaged position. As can be seen in FIG. 8, when flexible clamp 260 is in the disengaged position and positioned to engage bumper 252, angled segment 285 of lower clamp element 275 is received in the gap formed by lip 253 and upper clamp element 274 overlies a top surface of bumper 252. When flexible clamp 260 is then moved to the engaged position, bumper 252 is securely clamped between upper clamp element 274 and lower clamp element 275.

Still referring to FIG. 8, flexible clamp 260 is moved between the engaged position and the disengaged position by cable 288 and an elastomeric band 289. Cable 288 can be any flexible strand like material such as cable, wire, string, rope and the like, and extends from base element 270 through proximal segment 276 and distal segment 278, and through angled segment 285. Tightening of cable 288 through base element 270 shortens cable 288 and collapses upper clamp element 274 and lower clamp element 275 inwardly toward one another into the engaged position. Elastomeric band 289 extends along the outside of upper clamp element 274 and lower clamp element 275 and coupled proximate the ends thereof. When flexible clamp 260 is moved to the engaged position through tightening of cable 288, elastomeric band 289 is stretched to an extended position, storing energy therein. Upon release of cable 288, elastomeric band 289 retracts to its natural contracted position drawing upper clamp element 274 and lower clamp element 275 outwardly to the release position. It will be understood that while upper clamp element includes two segments, more can be employed as desired. Furthermore, while both upper clamp element 274 and lower clamp element 275 pivot inwardly and outwardly in the preferred embodiment, upper clamp element 274 can be pivoted toward a stationary lower clamp element 275 as an alternative. Furthermore, while the articulated version is preferred, the upper clamp element can be constructed of a stiff but flexible material such as an arm of an archery bow, but movable in the same manner as the articulated version but without the specific joints described.

In this preferred embodiment, socket member 271 of base element 270 receives a ball fitting 290 coupled to elongated pole 262. Cable 288 is coupled to elongated pole 262 to permit tightening and loosening thereof in any well-known manner. Dock tying mechanism 264 is substantially identical to dock tying mechanism 24 and will not be described in further detail. It will be understood that dock tying mechanism can be replaced with another flexible clamp 260 so as to couple watercraft together as opposed to a dock.

Thus, the present invention discloses and provides new and improved personal watercraft docking apparatus and more specifically personal watercraft docking apparatus that prevents all contact of the watercraft with the dock or other structure to which it is attached. Also, the watercraft docking apparatus is easy to attach to the watercraft without the necessity of the person attaching the apparatus being on the watercraft.

Various changes and modifications to the examples herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. Watercraft docking apparatus comprising:

a flexible clamp including:

a base element having an upper end and a lower end;

an upper clamp element coupled to the upper end of the base element;

a lower clamp element coupled to the lower end of the base element; and wherein the upper clamp element and the lower clamp element oppose one another and at least the upper clamp element is movable inwardly toward the lower clamp element to an engaged position and movable outwardly away from the lower clamp element to a disengaged position;

wherein the flexible clamp is moved to the engaged position by a cable and to the disengaged position by an elastomeric band;

an elongated pole attached at one end to the flexible clamp; and structure attaching mechanism attached to an opposite end of the elongated pole, the flexible clamp and the structure attaching mechanism are both designed to prevent lateral horizontal movement of the elongated pole.

2. The watercraft docking apparatus as claimed in claim 1 wherein the upper clamp element further includes a proximal segment and a distal segment pivotally coupled in series to the upper end of the base element.

3. The watercraft docking apparatus as claimed in claim 2 wherein the cable extends from the base element through the proximal segment and the distal segment, and is movable between a tightened position pulling the proximal segment and the distal segment inwardly toward the lower clamp element and a loosened position releasing the proximal segment and the distal segment.

4. The watercraft docking apparatus as claimed in claim 3 wherein the elastomeric band extends from the base element along an outside of the upper clamp element and is coupled proximate an end thereof and is movable between a stretched position when the cable is moved to the extended position pulling the proximal segment and the distal segment inwardly toward the lower clamp element and a contracted position drawing the upper clamp element and the lower clamp element outwardly to the release position.

5. The watercraft docking apparatus as claimed in claim 1 wherein the structure attaching mechanism includes a foot attached to the opposite end of the elongated pole and extending laterally to a longitudinal axis of the elongated pole and a flexible formable securing wrap extending from the foot.

6. Watercraft docking apparatus comprising:

a flexible clamp including:

a base element having an upper end and a lower end;

an upper clamp element having a proximal segment and a distal segment pivotally coupled in series to the upper end of the base element;

a lower clamp element coupled to the lower end of the base element; and wherein the upper clamp element and the lower clamp element oppose one another and the upper clamp element is movable inwardly toward the lower clamp element to an engaged position and movable outwardly away from the lower clamp element to a disengaged position;

wherein the flexible clamp is moved to the engaged position by a cable and to the disengaged position by an elastomeric band;

an elongated pole attached at one end to the flexible clamp; and structure attaching mechanism attached to an opposite end of the elongated pole, the flexible clamp and the structure attaching mechanism are both designed to prevent lateral horizontal movement of the elongated pole.

7. The watercraft docking apparatus as claimed in claim 6 wherein the lower clamp element includes an angled segment extending therefrom for engagement with a watercraft to be docked.

8. The watercraft docking apparatus as claimed in claim 6 wherein the cable extends from the base element through the proximal segment and the distal segment, and is movable between a tightened position pulling the proximal segment and the distal segment inwardly toward the lower clamp element and a loosened position releasing the proximal segment and the distal segment.

9. The watercraft docking apparatus as claimed in claim 8 wherein the elastomeric band extends from the base element along an outside of the upper clamp element and is coupled proximate an end thereof and is movable between a stretched position when the cable is moved to the extended position pulling the proximal segment and the distal segment inwardly toward the lower clamp element and a contracted position drawing the upper clamp element and the lower clamp element outwardly to the release position.

10. The watercraft docking apparatus as claimed in claim 6 wherein the structure attaching mechanism includes a foot attached to the opposite end of the elongated pole and extending laterally to a longitudinal axis of the elongated pole and a flexible formable securing wrap extending from the foot.

11. The watercraft docking apparatus as claimed in claim 6 wherein the structure attaching mechanism includes a second flexible clamp attached to the opposite end of the elongated pole.

12. The watercraft docking apparatus as claimed in claim 6 wherein the structure attaching mechanism is attached to the opposite end of the elongated pole by a rotatable joint designed to allow rotary movement of the elongated pole relative to the structure attaching mechanism only in a vertical direction.

13. The watercraft docking apparatus as claimed in claim 6 wherein the elongated pole is axially extendable.

14. The watercraft docking apparatus as claimed in claim 13 wherein the extendable pole includes two or more lengths of pole nested coaxially together or a telescoping arrangement.

15. Watercraft docking apparatus comprising:

an elongated pole;

a flexible clamp including:

a base element having an upper end and a lower end;

an upper clamp element having a proximal segment and a distal segment pivotally coupled in series to the upper end of the base element;

a lower clamp element pivotally coupled to the lower end of the base element; and wherein the upper clamp element and the lower clamp element oppose one another and are movable inwardly toward one another to an engaged position and movable outwardly away from one another to a disengaged position;

a cable extending from the base element through the proximal segment and the distal segment, and is movable between a tightened position pulling the proximal segment and the distal segment inwardly toward the lower clamp element to the engaged position and a loosened position releasing the proximal segment and the distal segment; and an elastomeric band extending from the base element along an outside of the upper clamp element and is coupled proximate an end thereof and is movable between a stretched position when the cable is moved to the extended position pulling the proximal segment and the distal segment inwardly toward the lower clamp element and a contracted position drawing the upper clamp element and the lower clamp element outwardly to the release position; and structure attaching mechanism attached to an opposite end of the elongated pole, the flexible clamp and the structure attaching mechanism are both designed to prevent lateral horizontal movement of the elongated pole.

16. The watercraft docking apparatus as claimed in claim 15 wherein the structure attaching mechanism includes a foot attached to the opposite end of the elongated pole and extending laterally to a longitudinal axis of the elongated pole and a flexible formable securing wrap extending from the foot.

17. The watercraft docking apparatus as claimed in claim 15 wherein the structure attaching mechanism includes a second flexible clamp attached to the opposite end of the elongated pole.

18. The watercraft docking apparatus as claimed in claim 15 wherein the structure attaching mechanism is attached to the opposite end of the elongated pole by a rotatable joint designed to allow rotary movement of the elongated pole relative to the structure attaching mechanism only in a vertical direction.

* * * * *